United States Patent [19]

Vistins

[11] 4,342,121

[45] Aug. 3, 1982

[54] HOT MILL GLOVE

[75] Inventor: Maris Vistins, Coshocton, Ohio

[73] Assignee: Norton Company, Worcester, Mass.

[21] Appl. No.: 184,594

[22] Filed: Sep. 5, 1980

[51] Int. Cl.[3] ..... A41D 19/00; A41D 19/02

[52] U.S. Cl. ..... 2/161 R; 2/164; 2/169

[58] Field of Search ..... 2/161 R, 164, 272, 159, 2/158, 169

[56] References Cited

U.S. PATENT DOCUMENTS

| | | | |
|---|---|---|---|
| 2,429,122 | 10/1947 | Crowley | 2/167 X |
| 3,132,348 | 5/1964 | Frenkel | 2/167 |
| 3,869,726 | 3/1975 | Bell | 2/164 |
| 3,945,049 | 3/1976 | Barlow | 2/167 X |

*Primary Examiner*—Richard J. Scanlan, Jr.
*Attorney, Agent, or Firm*—Rufus M. Franklin

[57] ABSTRACT

This disclosure is of a lined work glove which is manufactured utilizing adhesives or heat sealing techniques to eliminate sewing. This type of glove can be used in applications where hot mill gloves or terry cloth gloves are currently being used for hand protection.

9 Claims, 1 Drawing Figure

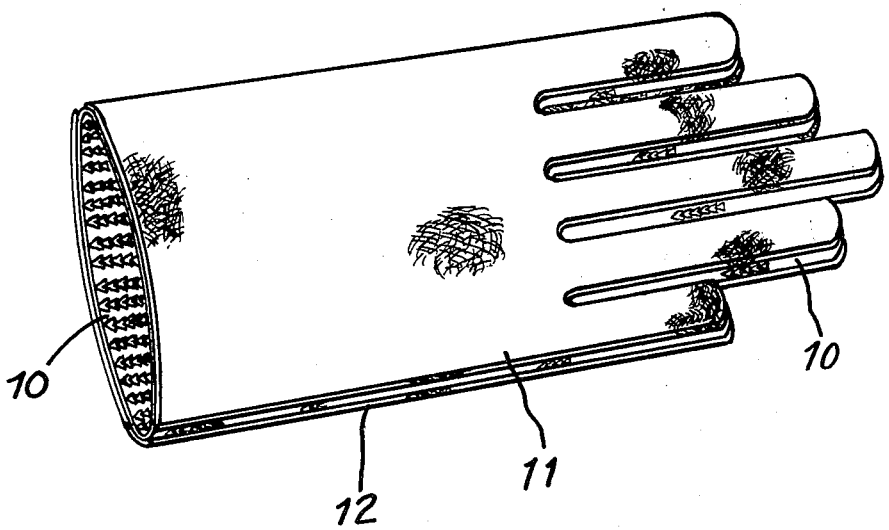
10
10
11
12

HOT MILL GLOVE

FIELD OF THE INVENTION

This invention relates to a method of making lined work gloves, and to the glove so produced.

BACKGROUND OF THE INVENTION

Conventional hot mill gloves are used in areas where there is a need for protection from heat which requires considerable bulk in a glove. Good wear, grip, cut resistance and dexterity are also important. To achieve this combination of properties, most hot mill gloves are made using a die cut and sewing process. The materials used are combinations of woven or nonwoven fabrics of various weights, quilted or laminated to achieve the necessary bulk. This lamination is then die cut in multiple layers and the various parts (fingers, thumbs, palms, backs, etc.) are sorted and stacked for sewing. Due to the multiple piece pattern and bulk, sewing is very difficult and requires considerable skill. The glove is then turned right side out, which is another difficult labor operation again due to the bulk and since the fabrics used do not stretch.

Terry cloth gloves, sometimes used as hot mill gloves, are made in a similar manner. The fabric is knitted to a desired weight and is stretchable. Therefore, the patterns are somewhat simpler and easier to turn. However, due to fabric bulk, sewing skill is necessary.

The disadvantages of the prior art methods are:

(1) high labor input
(2) requires highly skilled sewers
(3) high material cost
(4) high level of die cut scrap
(5) nonstretch materials limit patterns therefore requiring high material usage, uncomfortable seams, and the gloves can not be ambidextrous.

SUMMARY OF THE INVENTION

The present invention contemplates use of the following steps:

(1) a glove shell is automatically knitted by machine;
(2) the glove is turned inside out and loaded onto a flat hand form about ⅛ inch thick;
(3) lining fabric is die cut using the same configuration as the flat hand shaped form;
(4) adhesive is applied to the glove;
(5) the die cut lining is placed in the proper position on the glove coated with adhesive, and bonded;
(6) the same is done to the other side of the glove;
(7) the adhesive is dried; and
(8) the lined glove is removed from the form and turned right side out.

BRIEF DESCRIPTION OF THE DRAWING

The figure shows a glove of the invention, inside out, including a shell 10, and lining elements 11 and 12.

DETAILED DESCRIPTION OF THE INVENTION

The outer glove is knitted automatically on machines which are currently available. The hand size, finger lengths, cuff length, yarn type and weight can all be programmed into the machine. These very stretchy gloves can then easily be loaded onto flat hand shaped forms (approx. ⅛ inch thick) of the desired size or sizes).

The lining fabric can be a knitted, woven or nonwoven fabric or combination of fabrics of various weights.

This lining fabric will be die cut in multiple layers using only a simple one piece pattern of the same configuration as the flat hand shaped form.

A compatible adhesive is applied to the glove which is on the flat form by spraying, roller coating or other suitable method. The die cut lining is then aligned on the glove and bonded. The same is done to the other side of the glove.

Alternatively, the lining can be placed on the glove and heat sealed in position using radio frequency (RF) or ultrasonics if all or a portion of either the glove or lining is thermoplastic or if an adhesive has been applied to the lining fabric, prior to die cutting, that can be reactivated.

The adhesive is then dried, if necessary, the glove removed from the form, and turned right side out.

The advantages of the present invention are:

(1) minimal material cost
  (a) no die waste on glove
  (b) die waste minimal on lining due to one piece pattern.
(2) low labor input
  (a) no sewing required
  (b) minimal handling due to one piece lining per side
  (c) can be highly automated, short cycle time
  (d) stretchy fabrics are easy to load and turn
(3) no skilled labor required
(4) can be ambidextrous
(5) more comfortable design
  (a) stretch fabrics
  (b) no bulky seams
  (c) lining helps maintain a formed shape
  (d) lining reduces dirt penetration in use, which is a common problem on knitted gloves
(6) more durable
  (a) no sewn seams to fail
  (b) adhesive points will reinforce the glove and will help prevent expansion of cuts in the glove
(7) versatile process
  (a) glove size and materials can be easily changed
  (b) gloves can be custom designed by placing lining only where most needed (i.e., knuckle straps)

EXAMPLES

EXAMPLE 1

Use a 100% cotton glove with a waffle knit pattern and an elasticized wrist. Turn the glove inside out and load onto a flat hand shaped form. Die cut lining parts from a 4 oz/sq. yd. stitch bonded rayon nonwoven. Silk screen a liquid adhesive onto one side of the glove. (Adhesive usage is minimized by using a patterned coating.) Position a die cut piece of lining on the glove and bond. The same is done to the other side of the glove. Oven dry the adhesive, remove the glove from the form and turn right side out.

EXAMPLE 2

The outer glove is handled as in Example 1. The lining material has an adhesive applied to one side that can be reactivated, and parts are die cut. The part is positioned on the glove and bonded using RF, ultrasonics or heated platens.

EXAMPLE 3

Same as Example 2 except the adhesive is in a film form and die cut along with the lining. Then, both the adhesive and lining are positioned and bonded.

EXAMPLE 4

The glove is a 50/50 polyester/cotton blend as is the lining fabric. The die cut parts are positioned and bonded using RF or ultrasonics.

EXAMPLE 5

The glove is 100% cotton and the lining is a lamination of a 2 ox/sq. yd. polyester nonwoven and a 2 oz/sq. yd. rayon. The die cut lining is positioned on the glove with the polyester side toward the glove and bonded using RF or ultrasonics. Using this technique, no thermoplastic material is in contact with the hand which could be a safety hazard.

In each example, the gloves could be overcast in the thumb crotch area for added durability. The gloves could also be coated using conventional methods to improve wear, grip and cut resistance.

What is claimed is:

1. A glove comprising a knitted outer shell having an inner palm face and inner back face and having a lining fabric material adhered to said inner palm face of said shell and a separate fabric lining material adhered to said inner back face of said shell.

2. A glove as in claim 1 in which the lining includes thermoplastic fibers and is heat-bonded to the shell.

3. A method of making protective gloves comprising placing a knitted shell having a shape confirming to a hand, inside out, on a flat hand form, applying and adhesively sealing a fabric liner sheet to each inner side of said shell, and removing and turning the finished glove right side out.

4. A method as in claim 3 in which an adhesive is applied in a regular pattern between said shell and each of said liner sheets.

5. A method as in claim 3 in which thermoplastic yarns are employed in at least one of said shell and said lining sheets whereby said bonding elements are thermally bonded to the shell.

6. A method as in claim 3 in which a die cut heat activatable adhesive film is placed between the shell and each liner.

7. A method as in claim 3 in which the lining is a non-woven sheeting.

8. A method as in claim 7 in which the lining contains polyester fibers.

9. A method as in claim 7 in which the lining contains cotton and polyester fibers.

* * * * *